US008911218B2

(12) United States Patent
Sakai et al.

(10) Patent No.: US 8,911,218 B2
(45) Date of Patent: Dec. 16, 2014

(54) FUEL PUMP

(75) Inventors: Mitsuto Sakai, Toyota (JP); Tatsuhiko Akita, Okazaki (JP); Tsutomu Furuhashi, Okazaki (JP); Tatsumi Oguri, Okazaki (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 1326 days.

(21) Appl. No.: 12/672,043

(22) PCT Filed: Jul. 31, 2008

(86) PCT No.: PCT/JP2008/063752
§ 371 (c)(1),
(2), (4) Date: Feb. 4, 2011

(87) PCT Pub. No.: WO2009/020039
PCT Pub. Date: Feb. 12, 2009

(65) Prior Publication Data

US 2011/0129363 A1 Jun. 2, 2011

(30) Foreign Application Priority Data

Aug. 8, 2007 (JP) ..... 2007-206185

(51) Int. Cl.

| | |
|---|---|
| ***F04B 49/00*** | (2006.01) |
| ***F02M 59/34*** | (2006.01) |
| ***F02M 59/46*** | (2006.01) |
| ***F04B 53/10*** | (2006.01) |
| ***F04B 1/04*** | (2006.01) |
| ***F02M 59/36*** | (2006.01) |

(52) U.S. Cl.

CPC ..... *F02M 59/34* (2013.01); *F02M 59/462* (2013.01); *F04B 53/1085* (2013.01); *F04B 1/0448* (2013.01); *F04B 1/0456* (2013.01); *F02M 59/366* (2013.01)

USPC ..... 417/311; 137/469

(58) Field of Classification Search

USPC ..... 417/311, 540, 542, 543, 236, 283, 284, 417/288, 289, 308, 309; 137/469; 123/502

See application file for complete search history.

(56) References Cited

U.S. PATENT DOCUMENTS

| | | | | |
|---|---|---|---|---|
| 3,986,795 | A | 10/1976 | Kranc et al. | |
| 4,706,705 | A * | 11/1987 | Lee, II | 137/514.5 |
| 5,911,208 | A * | 6/1999 | Furusawa et al. | 123/506 |
| 6,210,127 | B1 * | 4/2001 | Hoshi et al. | 417/269 |
| 7,401,594 | B2 * | 7/2008 | Usui et al. | 123/467 |
| 7,513,240 | B2 * | 4/2009 | Usui et al. | 123/467 |

(Continued)

FOREIGN PATENT DOCUMENTS

| | | |
|---|---|---|
| CA | 1002836 A1 | 1/1977 |
| GB | 1474216 A | 5/1977 |

(Continued)

*Primary Examiner* — Devon Kramer
*Assistant Examiner* — Amene Bayou
(74) *Attorney, Agent, or Firm* — Sughrue Mion, PLLC

(57) ABSTRACT

In one embodiment, a small-diameter opening (42*b*) is formed in the central portion of a valve element (42) included in a check valve (40) of a high pressure fuel pump (1). A needle valve (44) is provided integrally with a valve element (35*a*) of an electromagnetic spill valve (30), and the opening (42*b*) of the valve element (42) can be opened and closed with a tip portion of the needle valve (44). When the high pressure fuel pump (1) switches from the drive state to the stopped state, the needle valve (44) retreats from the opening (42*b*) of the valve element (42) in conjunction with the movement of the valve element (35*a*) of the electromagnetic spill valve 30, thus forming a micro gap. When the high pressure fuel pump (1) is driven and the intake stroke is performed, the needle valve (44) obstructs the opening 42*b* of the valve element (42) in conjunction with the movement of the valve element (35*a*) of the electromagnetic spill valve 30, thus preventing the back-flow of fuel due to the existence of the micro gap.

4 Claims, 5 Drawing Sheets

(56) References Cited

U.S. PATENT DOCUMENTS

| | | | | |
|---|---|---|---|---|
| 8,317,501 | B2 * | 11/2012 | Inoue | 417/543 |
| 2001/0006061 | A1 * | 7/2001 | Shimada et al. | 123/495 |

FOREIGN PATENT DOCUMENTS

| | | | | |
|---|---|---|---|---|
| GB | 2099086 | A | * | 12/1982 |
| JP | 50-45122 | A | | 4/1975 |
| JP | 4-55254 | Y2 | | 12/1992 |
| JP | 07145763 | A | * | 6/1995 |
| JP | 08232686 | A | * | 9/1996 |
| JP | 2001-050174 | A | | 2/2001 |
| JP | 2001050174 | A | * | 2/2001 |
| JP | 2003-184697 | A | | 7/2003 |
| JP | 2006-090222 | A | | 4/2006 |
| JP | 2006-207451 | A | | 8/2006 |

* cited by examiner

FUEL PUMP

TECHNICAL FIELD

The present invention is applicable to an internal combustion engine such as an in-cylinder direct injection engine, and relates to a fuel pump for supplying high pressure fuel to a fuel injection valve (injector). In particular, the present invention relates to a measure for improving the discharge efficiency of a fuel pump.

BACKGROUND ART

Conventionally, with an engine in which high pressure is required for fuel that is supplied to an injector, such as with an in-cylinder direct injection engine for example, fuel that has been pumped from a fuel tank is compressed by a high pressure fuel pump, and then supplied to the injector.

Specifically, as disclosed in Patent Literature 1 below as well, a fuel supply system in this type of engine is configured so as to include a feed pump that pumps out fuel from the fuel tank, and a high pressure fuel pump that compresses the fuel that has been pumped out by the feed pump. Then, the fuel that has been compressed by the high pressure fuel pump is retained in a delivery pipe that is connected to a plurality of injectors. Accordingly, along with an opening operation of the injectors, the high pressure fuel retained in the delivery pipe is ejected from the open injectors toward a combustion chamber.

Also, the high pressure fuel pump included in the fuel supply system of this type of engine includes a plunger that reciprocates in a cylinder, a compression chamber that is defined by the plunger and the cylinder, and a discharge valve (check valve) arranged on the discharge side of the compression chamber. The volume of the compression chamber changes due to the reciprocation of the plunger in the cylinder, and thus fuel is taken into the compression chamber when the volume expands, and at a predetermined timing when the volume contracts, the discharge value is released and high pressure fuel is pumped toward the delivery pipe.

More specifically, the high pressure fuel pump is provided with an electromagnetic spill valve that opens and blocks off communication between the compression chamber and a low pressure fuel pipe on the intake side thereof, and in the compression stroke, the volume of the compression chamber is reduced due to the movement of the plunger in the cylinder. Then, while the electromagnetic spill valve is open during the compression stroke, fuel flows out of the compression chamber to the low pressure fuel pipe (flows out to the feed pump side), and therefore fuel is not pumped toward the delivery pipe. In contrast, when the electromagnetic spill valve is closed during the compression stroke, the pressure (fuel pressure) in the compression chamber rises, the discharge valve starts the opening operation when the pressure exceeds a resultant force obtained by adding together the biasing force of a coil spring that causes the valve element of the discharge valve to be biased in the closed direction and the fuel pressure in the delivery pipe, and fuel is pumped toward the delivery pipe during the closed period of the electromagnetic spill valve. In this way, the amount of fuel that is pumped from the high pressure fuel pump to the delivery pump is adjusted by controlling the closed period of the electromagnetic spill valve during the compression stroke.

With a fuel supply system that includes this type of high pressure fuel pump, when the engine has stopped, there is a high possibility that the internal pressure in the delivery pipe is in a high state since high pressure fuel had been pumped toward the delivery pipe by the high pressure fuel pump up to that time. Then, in a situation in which the internal pressure in the delivery pipe is maintained in the high state while the engine is stopped, it is possible for fuel to leak from the injection opening of the injector into the cylinder that the injection opening of the injector faces, as a result of, for example, the increase in the difference between the pressure in the space inside the injector on which the internal pressure of the delivery pipe acts and the internal pressure of the cylinder. In such a situation, there is concern that the presence of fuel that has leaked into the cylinder will adversely affect the next instance of engine starting.

In view of this point, in for example Patent Literature 2 and Patent Literature 3 below, a micropore is formed in the check valve arranged on the discharge side of the compression chamber, and after the engine has been stopped, fuel gradually returns to the high pressure fuel pump side through the micropore, which reduces the internal pressure in the delivery pipe, thereby preventing the leakage of fuel from the injector.

CITATION LIST

Patent Literature

[PTL 1]
JP 2006-207451A
[PTL 2]
JP 2003-184697A
[PTL 3]

SUMMARY OF INVENTION

Technical Problem

However, the configurations in the above Patent Literature 2 and Patent Literature 3 have the problems described below.

As described above, with the configurations in Patent Literature 2 and Patent Literature 3, the leakage of fuel from the injector can be prevented by reducing the internal pressure in the delivery pipe when the engine is stopped, but when the engine is started thereafter, there is the possibility that a relatively large volume of fuel will flow back through the micropore in the check valve at high speed during the intake stroke that accompanies the plunger descending operation. If such back-flowing of fuel occurs, the amount of fuel introduced from the fuel tank side decreases, thus leading to a reduction in the discharge efficiency of the fuel pump.

Additionally, there is also the possibility that cavitation erosion (impact force that accompanies the bursting of air bubbles produced in fuel flowing at high speed) will occur in the fuel flowing back through the micropore at high speed, thus adversely affecting the high pressure fuel pump.

An object of the present invention is to provide a configuration that can improve discharge efficiency in a fuel pump having a check valve that includes a micro gap for reducing fuel pressure on the discharge side when stopped, by preventing the back-flow of fuel through the micro gap during the intake stroke.

Solution to Problem

Principle of Solution to Problem

The principle of a solution of the present invention is that a configuration is provided in which it is possible to obstruct the micro gap provided in order to reduce the fuel pressure on the pump discharge side when the pump is stopped, and the back-flow of fuel through the micro gap is prevented by obstructing the micro gap in the intake stroke of the fuel pump. In particular, the present invention is configured such that in a fuel pump that includes a spill valve, the opening and closing operation of the spill valve and a mechanism portion for opening and closing the micro gap are linked, and therefore the drive source for causing the opening and closing operation of the spill valve to be performed can be used as the drive source for opening and closing the micro gap.

Solution Means

A fuel pump of the present invention is provided with a compression chamber for compressing fuel, and a discharge valve element that is arranged on a discharge side of the compression chamber and to which biasing force in a valve closing direction is applied, and is configured such that fuel is taken into the compression chamber in an intake stroke, and in a case in which pressure in the compression chamber has reached or exceeded a predetermined pressure in a compression stroke, the discharge valve element moves in a valve opening direction against the biasing force, and fuel is discharged from the compression chamber toward a fuel injection valve, the fuel pump including: a micro gap opening/closing portion (micro gap opening/closing means) that, in a case of a change from a pump drive state to a pump stopped state, causes the compression chamber and a space on a downstream side of the discharge valve element to be in communication with use of a micro gap, and in at least the intake stroke during pump driving, obstructs the micro gap, wherein an opening that enables communication between the compression chamber and the space on the downstream side of the discharge valve element is formed in the discharge valve element, the micro gap opening/closing portion is provided with a micro gap opening/closing element that can advance and retreat between a first advance/retreat position reached by retreating from the opening of the discharge valve element to release the opening and cause the compression chamber and the space on the downstream side of the discharge valve element to be in communication, and a second advance/retreat position reached by advancing toward the opening of the discharge valve element to obstruct the opening and block off the compression chamber and the space on the downstream side of the discharge valve element, and the micro gap opening/closing element is configured so as to open and close a micro gap formed between an inner edge portion of the opening and the micro gap opening/closing element by, with use of an electromagnetic solenoid as a drive source, moving between the first advance/retreat position and the second advance/retreat position according to conduction/non-conduction of electricity to the electromagnetic solenoid. The "predetermined pressure" referred to here is the set discharge pressure of the fuel pump, which is set arbitrarily in accordance with, for example, the injection pressure required for the fuel injection valve.

According to this specified matter, when the fuel pump switches from the drive state to the stopped state, the space on the discharge side of the fuel pump (e.g., the internal space in the delivery pipe in the case of an in-cylinder direct injection internal combustion engine) is in a high pressure state since high pressure fuel had been discharged up to that point. In such a situation, the micro gap opening/closing element retreats from the opening of the discharge valve element to the first advance/retreat position, thus releasing the opening of the discharge valve element and causing the compression chamber and the space on the downstream side of the discharge valve element to be in communication. Accordingly, fuel gradually returns to the fuel pump side with use of the micro gap formed between the edge portion of the opening of the discharge valve element and the micro gap opening/closing element, and the pressure in the space on the discharge side of the fuel pump decreases. This consequently enables preventing the leakage of fuel from the fuel injection valve into the cylinder.

On the other hand, when the fuel pump is started and the intake stroke is performed, the micro gap opening/closing element advances toward the opening of the discharge valve element to the second advance/retreat position, thus obstructing the opening and blocking off the compression chamber and the space on the downstream side of the discharge valve element. Accordingly, in the intake stroke, the back-flow of fuel from the space on the downstream side of the discharge valve element toward the compression chamber is prevented, the discharge efficiency of the fuel pump is improved, and cavitation erosion does not occur. Note that in the intake stroke, the discharge valve element does not move in the valve opening direction since the pressure in the compression chamber is low (e.g., a pressure roughly equal to the discharge pressure of a feed pump arranged on the upstream side), and the blocked off state of the compression chamber and the space on the downstream side of the discharge valve element is maintained by the discharge valve element as well.

In this way, according to the present solution means, it is possible to realize a fuel pump having a high discharge efficiency by preventing the back-flow of fuel in the intake stroke, while preventing the leakage of fuel from the fuel injection valve after the fuel pump has stopped.

The following is a specific configuration of the fuel pump and a specific configuration for causing the micro gap opening/closing element to advance and retreat. First, the compression chamber may be defined by a cylinder and a plunger that reciprocates in the cylinder. Also, the fuel pump may be configured such that a spill valve that can perform an opening and closing operation according to operation of the electromagnetic solenoid is provided on an intake side of the compression chamber, and a pumping amount is adjusted by controlling the opening and closing operation of the spill valve during the compression stroke in which the plunger moves in a direction for reducing a volume of the compression chamber. Also, the fuel pump is configured such that the micro gap opening/closing element of the micro gap opening/closing portion is linked to the spill valve, reaches the second advance/retreat position by operating in conjunction with an opening operation of the spill valve, and reaches the first advance/retreat position by operating in conjunction with a closing operation of the spill valve.

The pumping amount is adjusted by controlling the closing timing of the spill valve when the plunger moves in the direction for reducing the volume of the compression chamber. In other words, the compression operation in the compression chamber is started earlier as the closing timing of the spill valve is earlier, thus obtaining a higher pumping amount. Also, according to the present solution means, the micro gap opening/closing element of the micro gap opening/closing portion is linked to the spill valve, and if the spill valve is released, the micro gap opening/closing element is moved to the second advance/retreat position, thus closing the opening of the discharge valve element. In other words, the compression chamber and the space on the downstream side of the discharge valve element are blocked off by obstructing the micro gap. Specifically, at the timing when the spill valve is released, either the intake stroke is being performed, or the plunger is moving in the direction for reducing the volume of the compression chamber but a non-compression operation for discharging fuel in the compression chamber to the intake side is being performed. In this case, since the micro gap opening/closing element is at the second advance/retreat position, in the intake stroke and in the non-compression operation, the back-flow of fuel from the space on the downstream side of the discharge valve element toward the compression chamber is prevented, and the discharge efficiency of the fuel pump is improved. On the other hand, if the spill valve is closed, the micro gap opening/closing element of the micro gap opening/closing portion is at the first advance/retreat position, thus releasing the opening of the discharge valve element. In other words, the opening of the discharge valve element is released at substantially the same time as the spill valve is closed in order to start the fuel compression operation when the plunger is moving in the direction for reducing the volume of the compression chamber, and in the case in which the pressure in the compression chamber has reached or exceed the predetermined pressure, high pressure fuel can be discharged via not only the discharge passage obtained by the movement of the discharge valve element in the valve opening direction, but also with use of the opening formed in the discharge valve element.

Also, in the case in which such a spill valve is provided, when using a so-called "normally open" type of valve in which the spill valve is open when the fuel pump is stopped, in a conventional configuration a micro gap for pressure reduction constantly exists, therefore causing the fuel tank and the space on the discharge side of the fuel pump to be in communication, and if this situation continues for a long period of time, the pressure in the space on the discharge side of the fuel pump (e.g., the pressure in the delivery pipe) falls more than necessary (falls to a pressure that is significantly lower than the amount of pressure reduction sufficient for preventing the leakage of fuel from the fuel injection valve), and there is the possibility of adversely affecting the starting properties of the internal combustion engine. In the present solution means, the spill valve is closed when the fuel pump switches from the drive state to the stopped state, and the micro gap opening/closing element moves to the first advance/retreat position along with this, thus causing the compression chamber and the space on the downstream side of the discharge valve element to be in communication. In other words, communication between the fuel tank and the space on the discharge side of the fuel pump is not opened since the spill valve is in a closed state. Also, even if the spill valve opens thereafter, the micro gap opening/closing element moves to the second advance/retreat position along with this, thus obstructing the opening formed in the discharge valve element. In this case, communication between the fuel tank and the space on the discharge side of the fuel pump is not opened since the micro gap no longer exists. Accordingly, this configuration enables avoiding the situation in which the pressure in the space on the discharge side of the fuel pump falls more than necessary.

The following is a more specific configuration relating to the discharge valve element and the micro gap opening/closing element. First, the discharge valve element is able to close a discharge passage on a discharge side of the compression chamber by being caused, due to receiving biasing force of a biasing portion (biasing means), to abut against a valve seat portion formed in the discharge passage, and in a case in which pressure in the compression chamber has reached or exceeded the predetermined pressure in the compression stroke, the discharge valve element releases the discharge passage by retreating from the valve seat portion against the biasing force of the biasing portion, and fuel is discharged from the compression chamber. Also, the fuel pump is configured such that after the micro gap opening/closing element is at the second advance/retreat position and the opening of the discharge valve element is obstructed in the intake stroke, the compression stroke is performed, the micro gap opening/closing element reaches the first advance/retreat position, the pressure in the compression chamber reaches or exceeds the predetermined pressure, and the discharge valve element retreats from the valve seat portion and retreats from the micro gap opening/closing element along with this, and accordingly fuel is discharged from the opening of the discharge valve element as well.

According to this configuration as well, in the case in which the pressure in the compression chamber has reached or exceed the predetermined pressure in the compression stroke, high pressure fuel can be discharged via not only the discharge passage obtained by the opening operation of the discharge valve element, but also with use of the opening formed in the discharge valve element.

Advantageous Effects of Invention

With the present invention, a configuration is provided in which it is possible to obstruct a micro gap provided in order to reduce the fuel pressure on the pump discharge side when the pump is stopped, and the back-flow of fuel through the micro gap can be prevented by obstructing the micro gap in the intake stroke of the pump. This enables realizing a fuel pump having a high discharge efficiency due to preventing the back-flow of fuel in the intake stroke, as well preventing the leakage of fuel from the fuel injection valve after the fuel pump has stopped.

DESCRIPTION OF EMBODIMENTS

Below is a description of embodiments of the present invention with reference to the drawings. The embodiments of the present invention describe cases in which a fuel pump according to the present invention has been applied to a fuel supply system in an in-cylinder direct injection type of multi-cylinder (e.g., four-cylinder) gasoline engine mounted in an automobile.

Embodiment 1

—Fuel Supply System—

Figure 1:
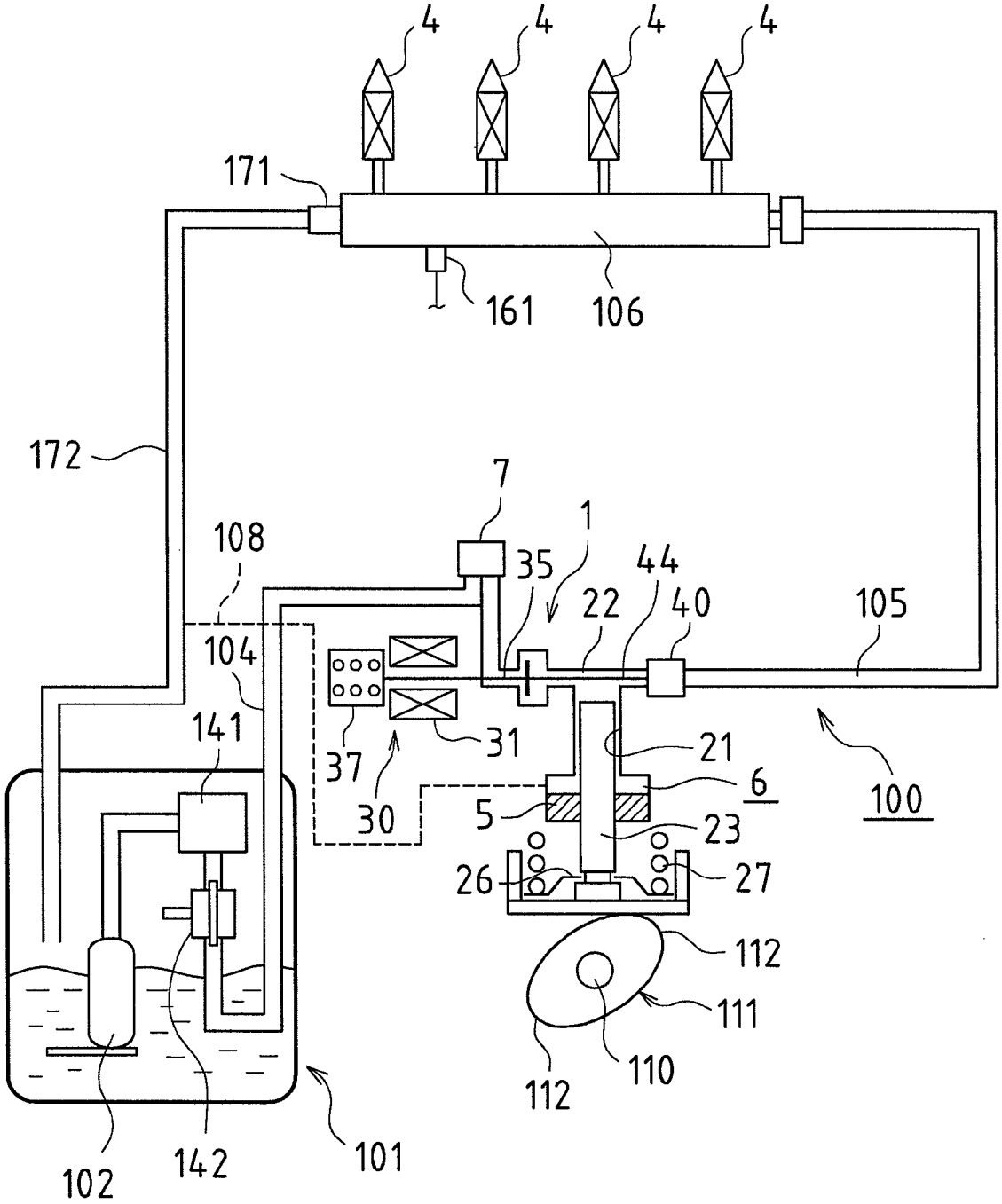
FIG. 1 is a diagram schematically showing a structure of a fuel supply system according to an embodiment.

FIG. 1 is a diagram schematically showing the structure of a fuel supply system 100 in the present embodiment. As shown in FIG. 1, the fuel supply system 100 includes a feed pump 102 composed of an electric pump that pumps outs fuel from a fuel tank 101, and a high pressure fuel pump 1 that compresses the fuel pumped out by the feed pump 102 and discharges the compressed fuel to injectors (fuel injection valves) 4 in cylinders (four cylinders).

In terms of basic configuration (a specific configuration is described later with reference to FIG. 3), the high pressure fuel pump 1 includes a cylinder 21, a plunger 23, a compression chamber 22, and an electromagnetic spill valve 30. The plunger 23 is driven by the rotation of a drive cam 111 that is attached to an exhaust cam shaft 110 in the engine, and the plunger 23 reciprocates in the cylinder 21. The volume of the compression chamber 22 expands and contracts due to the reciprocation of the plunger 23. In the present embodiment, two cam mountains (cam noses) 112 and 112 have been formed on the drive cam 111 with an angular interval of 180° about the rotational axis of the exhaust cam shaft 110. The plunger 23 moves inside the cylinder 21 due to being pushed upward by the cam noses 112. Note that since the engine according to the present embodiment is a four-cylinder type of engine, in one cycle of the engine, that is to say, while the crank shaft rotates twice, the injector 4 provided in each cylinder injects fuel one time, and thus fuel injection is performed a total of four times. Also, with this engine, the exhaust cam shaft 110 rotates one time each time the crank shaft rotates twice. Accordingly, in each engine cycle, fuel injection from the injectors 4 is performed four times, and a discharge operation is performed by the high pressure fuel pump 1 two times.

The compression chamber 22 is defined by the plunger 23 and the cylinder 21. The compression chamber 22 is in communication with the feed pump 102 via a low pressure fuel pipe 104, and is in communication with a delivery pipe (accumulated pressure container) 106 via a high pressure fuel pipe 105.

The injectors 4 are connected to the delivery pipe 106, and the delivery pipe 106 is provided with a fuel pressure sensor 161 that detects the fuel pressure (actual fuel pressure) therein. Also, a return pipe 172 is connected to the delivery pipe 106 via a relief valve 171. The relief valve 171 opens when the fuel pressure in the delivery pipe 106 has exceeded a predetermined pressure (e.g., 13 MPa). Due to the opening of this valve, part of the fuel accumulated in the delivery pipe 106 returns to the fuel tank 101 via the return pipe 172. This prevents an excessive rise in the fuel pressure in the delivery pipe 106. Also, the return pipe 172 and the high pressure fuel pump 1 are connected by a fuel discharge pipe 108 (shown by a dashed line in FIG. 1), and thus fuel that has leaked out through the gap between the plunger 23 and the cylinder 21 is accumulated in a fuel housing chamber 6 above a seal unit 5, and thereafter is returned to the fuel discharge pipe 108 that is connected to the fuel housing chamber 6.

Note that the low pressure fuel pipe 104 is provided with a filter 141 and a pressure regulator 142. The pressure regulator 142 maintains the fuel pressure in the low pressure fuel pipe 104 at a pressure less than or equal to the predetermined pressure by causing fuel in the low pressure fuel pipe 104 to return to the fuel tank 101 when the fuel pressure in the low pressure fuel pipe 104 has exceeded a predetermined pressure (e.g., 0.4 MPa). Also, the low pressure fuel pipe 104 includes a pulsation damper 7, and the pulsation damper 7 suppresses pulsation in the fuel pressure in the low pressure fuel pipe 104 that occurs when the high pressure fuel pump 1 is operating.

The high pressure fuel pump 1 is provided with the electromagnetic spill valve 30 that is for opening and blocking off communication between the low pressure fuel pipe 104 and the compression chamber 22. The electromagnetic spill valve 30 includes an electromagnetic solenoid 31 that is a drive source, and the opening and closing operation of the electromagnetic spill valve 30 is performed by controlling the conduction of electricity to the electromagnetic solenoid 31. The electromagnetic spill valve 30 is a so-called "normally open" type of valve that opens due to the biasing force of a coil spring 37 when electrical conduction to the electromagnetic solenoid 31 is stopped. The following describes the opening and closing operation of the electromagnetic spill valve 30 with reference to FIGS. 2(*a*) and 2(*b*).

First, in the state in which electrical conduction to the electromagnetic solenoid 31 has been stopped, the electromagnetic spill valve 30 opens due to the biasing force of the coil spring 37, and communication between the low pressure fuel pipe 104 and the compression chamber 22 is opened (see the state shown in FIG. 1). In this state, when the plunger 23 moves in a direction such that the volume of the compression chamber 22 increases (the intake stroke), fuel that has been pumped out from the feed pump 102 is taken into the compression chamber 22 via the low pressure fuel pipe 104.

On the other hand, when the plunger 23 moves in a direction such that the volume of the compression chamber 22 decreases (the compression stroke), the electromagnetic spill valve 30 closes against the biasing force of the coil spring 37 due to the conduction of electricity to the electromagnetic solenoid 31, thus blocking off the low pressure fuel pipe 104 and the compression chamber 22, and when the fuel pressure in the compression chamber 22 has reached a predetermined value, the check valve 40 opens, and high pressure fuel is discharged toward the delivery pipe 106 through the high pressure fuel pipe 105 (the configuration of the check valve 40 is described later).

Adjustment of the fuel discharge amount in the high pressure fuel pump 1 is performed by controlling the closed period of the electromagnetic spill valve 30 in the compression stroke. Specifically, if the closed period is lengthened by setting the closing start time of the electromagnetic spill valve 30 earlier, the fuel discharge amount increases, and if the closed period is shortened by delaying the closing start time of the electromagnetic spill valve 30, the fuel discharge amount decreases. In this way, the fuel pressure in the delivery pipe 106 is controlled by adjusting the fuel discharge amount of the high pressure fuel pump 1.

The following describes a pump duty DT, which is a controlled variable for controlling the fuel discharge amount (closing start time of the electromagnetic spill valve 30) of the high pressure fuel pump 1.

The pump duty DT varies between the values of 0% and 100%, and is a value associated with the cam angle of the drive cam 111 of the exhaust cam shaft 110 that corresponds to the closed period of the electromagnetic spill valve 30.

Figure 2:
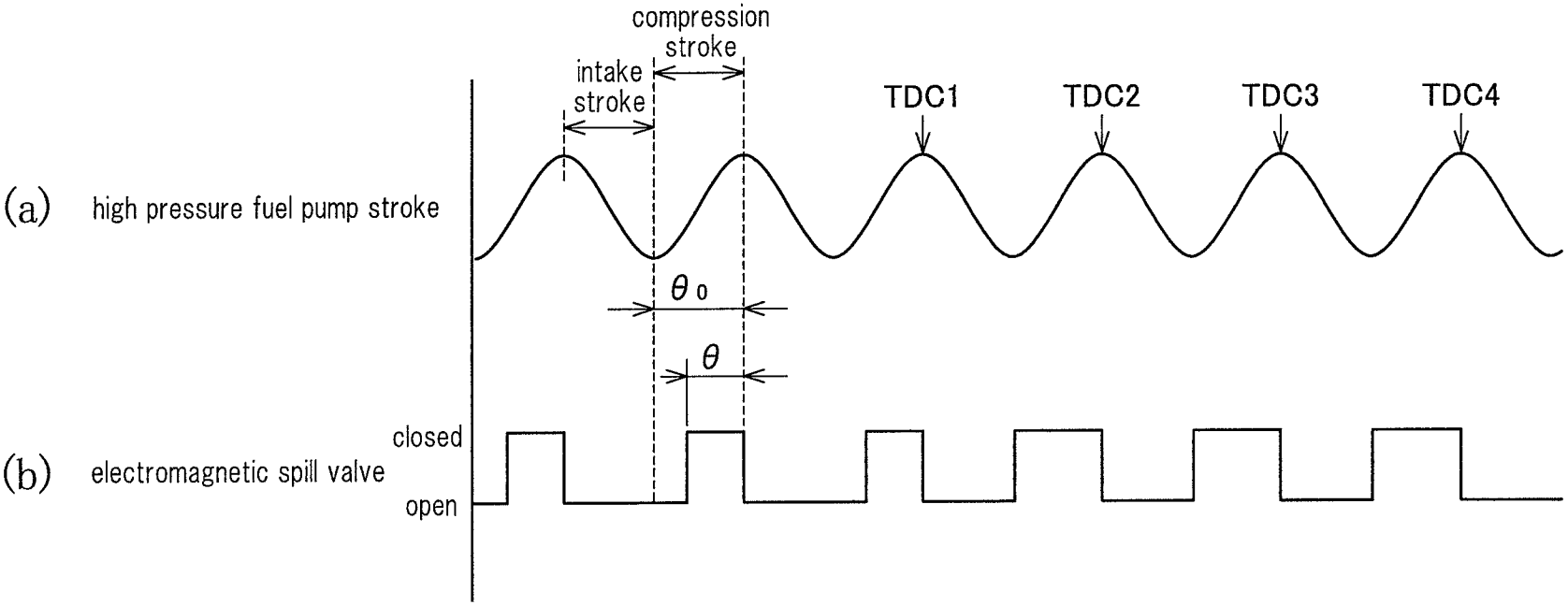
FIGS. 2(*a*) and 2(*b*) are diagrams for describing an opening and closing operation of an electromagnetic spill valve.

Specifically, regarding the cam angle of the drive cam 111, as shown in FIGS. 2(*a*) and 2(*b*), letting the cam angle corresponding to the maximum closed period of the electromagnetic spill valve 30 (maximum cam angle) be $\theta_0$, and letting the cam angle corresponding to the target fuel pressure of the maximum closed period (target cam angle) be $\theta$, the pump duty DT is expressed by the ratio of the target cam angle $\theta$ to the maximum cam angle $\theta_0$ ($DT=\theta/\theta_0$). Accordingly, the pump duty DT is a value that is closer to 100% as the target closed period (closing start time) of the electromagnetic spill valve 30 approaches the maximum closed period, and that is closer to 0% as the target closed period approaches "0".

Also, as the pump duty DT approaches 100%, the closing start time of the electromagnetic spill valve 30 that is adjusted based on the pump duty DT is made earlier, and the closed period of the electromagnetic spill valve 30 becomes longer. As a result, the fuel discharge amount of the high pressure fuel pump 1 increases, and the actual fuel pressure rises. Also, as the pump duty DT approaches 0%, the closing start time of the electromagnetic spill valve 30 that is adjusted based on the pump duty DT is delayed, and the closed period of the electromagnetic spill valve 30 becomes shorter. As a result, the fuel discharge amount of the high pressure fuel pump 1 decreases, and the actual fuel pressure falls. Note that a description of details of the procedure for calculating the pump duty DT has been omitted.

—Specific Configuration of High Pressure Fuel Pump 1—

Figure 3:
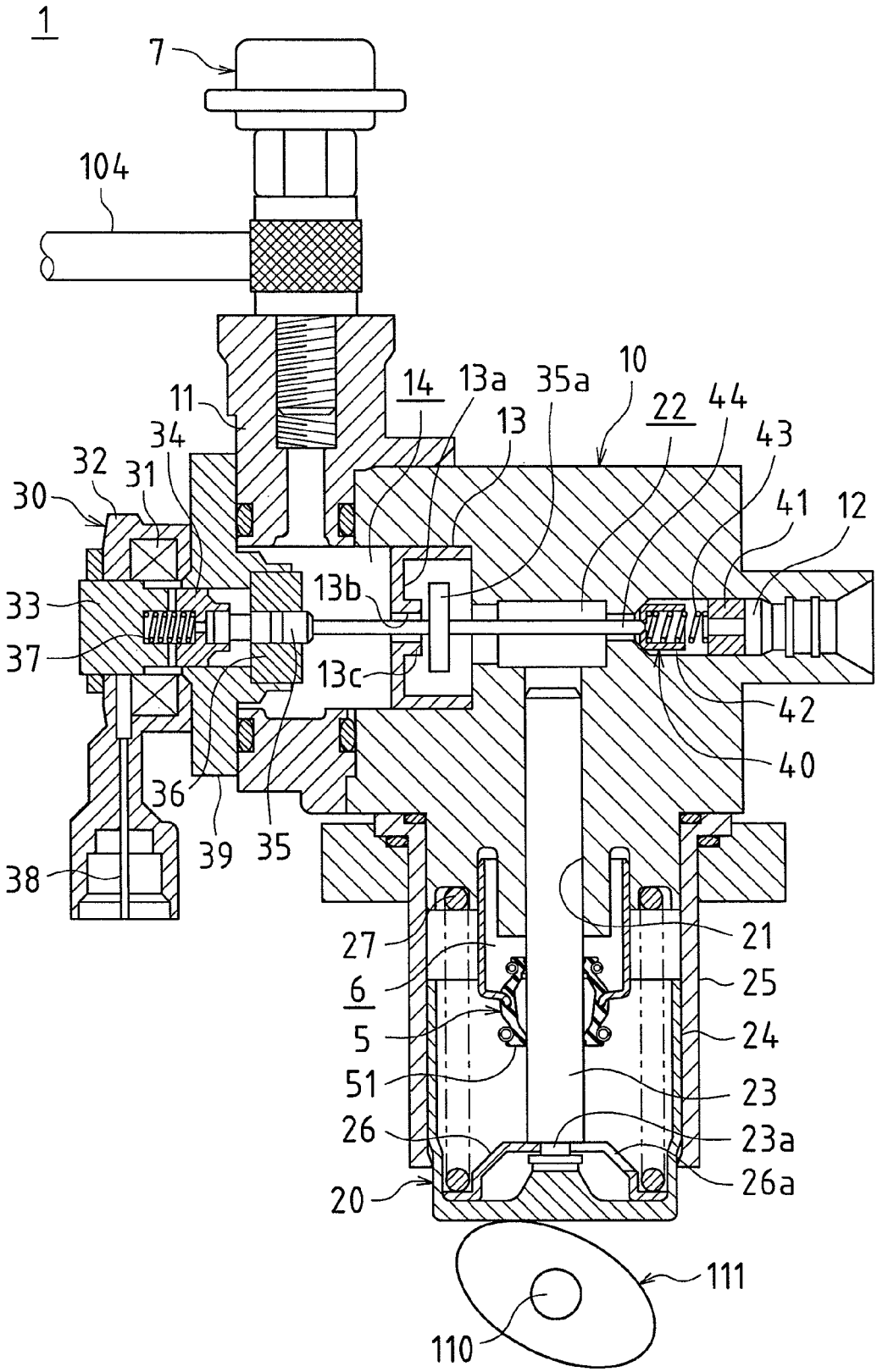
FIG. 3 is a vertical cross-sectional diagram showing a high pressure fuel pump.

Next is a description of a specific configuration of the high pressure fuel pump 1 with reference to FIG. 3. FIG. 3 is a vertical cross-sectional diagram of the high pressure fuel pump 1. As shown in FIG. 3, the high pressure fuel pump 1 of the present embodiment has a configuration in which a pump portion 20, the electromagnetic spill valve 30, and the check valve 40 are included in a housing 10.

<Pump Portion 20>

The pump portion 20 includes the cylinder 21, the compression chamber 22, the plunger 23, a lifter 24, and a lifter guide 25. The cylinder 21 is formed in the central portion of the housing 10, and the compression chamber 22 is formed on the tip side thereof (the top end side in FIG. 3). The plunger 23 is columnar, and is inserted into the cylinder 21 so as to be capable of sliding in the axis direction thereof. The lifter 24 has been formed into a bottomed cylinder shape, and the base end portion of the plunger 23, a retainer 26 that is described later, a coil spring 27, and the like are housed therein. The lifter guide 25 is a cylindrical member attached to the bottom side of the housing 10, and the lifter 24 is stored in the lifter guide 25 so as to be capable of sliding in the axis direction.

The retainer 26 is engaged with the base end portion of the plunger 23. Specifically, the base end portion of the plunger 23 is provided with a small diameter portion 23*a*, a groove 26*a* whose width substantially matches the outer diameter dimension of the small diameter portion 23*a* has been formed in the retainer 26, and due to the small diameter portion 23*a* being fitted into the groove 26*a*, the base end portion of the plunger 23 is engaged with the retainer 26 such that they reciprocate integrally. Also, the coil spring 27 has been disposed between the bottom face of the housing 10 and the retainer 26 in a compressed state. In other words, due to the coil spring 27, a downward biasing force is applied to the plunger 23, and the lifter 24 is biased toward the drive cam 111. Note that the center position on the outer circumferential face of the drive cam 111 (the center position in the rotation axis direction of the drive cam 111) and the central point on the bottom face of the lifter 24 are out of alignment (eccentric) along the rotation axis direction of the drive cam 111, that is to say, these two have been offset disposed, so to speak. Also, the offset direction is such that the lifter 24 is caused to rotate in the clockwise direction in plan view with use of frictional force between the outer circumferential face of the drive cam 111 and the bottom face of the lifter 24.

<Electromagnetic Spill Valve 30>

The electromagnetic spill valve 30 is arranged in opposition to the compression chamber 22, and the electromagnetic spill valve 30 includes the electromagnetic solenoid 31, a bobbin 32, a core 33, an armature 34, an intake valve 35, a guide member 36, and a valve sheet member 13. The electromagnetic solenoid 31 is formed from a coil that has been wound in a ring shape in the bobbin 32, and the core 33 is fitted and fixed in a central through-hole of the bobbin 32. The armature 34 is fixed to one end of the intake valve 35, and is disposed such that a portion of the armature 34 can enter the central through-hole of the bobbin 32 coaxially with the core 33. Concave portions have been formed in the opposing faces of the core 33 and the armature 34, and the coil spring 37 is housed between these concave portions in a compressed state. The armature 34 is biased toward the compression chamber 22 side by the coil spring 37.

The intake valve 35 is slidably inserted into a through-hole in the guide member 36 and also has a disc-shaped valve element 35*a* formed thereon.

Also, the valve sheet member 13 is a substantially cylindrical member, and is fitted into a fuel intake space 14 in the housing 10, which is a space in communication with the compression chamber 22. Also, the valve sheet member 13 includes a disc portion 13*a* in which a fuel introduction opening 13*b* has been formed in the central portion so as to oppose the guide member 36, and a valve sheet 13*c* that protrudes in a sleeve shape (cylindrically) from the circumferential edge of the fuel introduction opening 13*b* formed in the disc portion 13*a* toward the compression chamber 22 side. Also, the valve element 35*a* of the intake valve 35 is positioned inside the valve sheet member 13 so as to oppose the valve sheet 13*c*.

Accordingly, when electricity is not conducted to the electromagnetic solenoid 31, due to the biasing force of the coil spring 37, the valve element 35*a* of the intake valve 35 is separated from the valve sheet 13*c*, the fuel introduction opening 13*b* formed in the disc portion 13*a* is released, and the electromagnetic spill valve 30 enters the opened state (the state shown in FIG. 3). In this state, fuel can flow between the low pressure fuel pipe 104 and the compression chamber 22. On the other hand, when electricity is conducted from an electrical control apparatus (not shown) to the electromagnetic solenoid 31 via a terminal 38, a magnetic circuit is formed by the core 33, the armature 34, and a support member 39 that supports the entirety of the electromagnetic spill valve 30, and the armature 34 moves to the core 33 side against the biasing force of the coil spring 37. Accordingly, the intake valve 35 moves to the side opposite from the compression chamber 22, the valve element 35*a* abuts against the valve sheet 13*c*, and thus the electromagnetic spill valve 30 enters the closed state. In this state, the low pressure fuel pipe 104 and the compression chamber 22 are blocked off.

An intake tube member 11 whose internal space is in communication with the fuel intake space 14 is attached to the housing 10. Also, when the plunger 23 descends while the electromagnetic spill valve 30 is in the opened state, low-pressure fuel that has been pumped up from the fuel tank 101 by the operation of the feed pump 102 is taken into the compression chamber 22 via the filter 141, the pressure regulator 142, the pulsation damper 7, the intake tube member 11, and the fuel intake space 14.

The compression chamber 22, which has been formed on the tip side of the cylinder 21, has been formed so as to have a diameter that is larger than the inner diameter of the cylinder 21. The plunger 23 ascends before or simultaneously with the closing timing of the electromagnetic spill valve 30, and reaches top dead center after the electromagnetic spill valve 30 has closed. Also, a fuel discharge passage 12 has been formed in the housing 10, and the check valve 40 is arranged in the fuel discharge passage 12. The axial center of the fuel discharge passage 12 and check valve 40 and the axial center of the intake valve 35 are arranged on the same axis extending in the horizontal direction.

<Check Valve 40>

Figure 4:
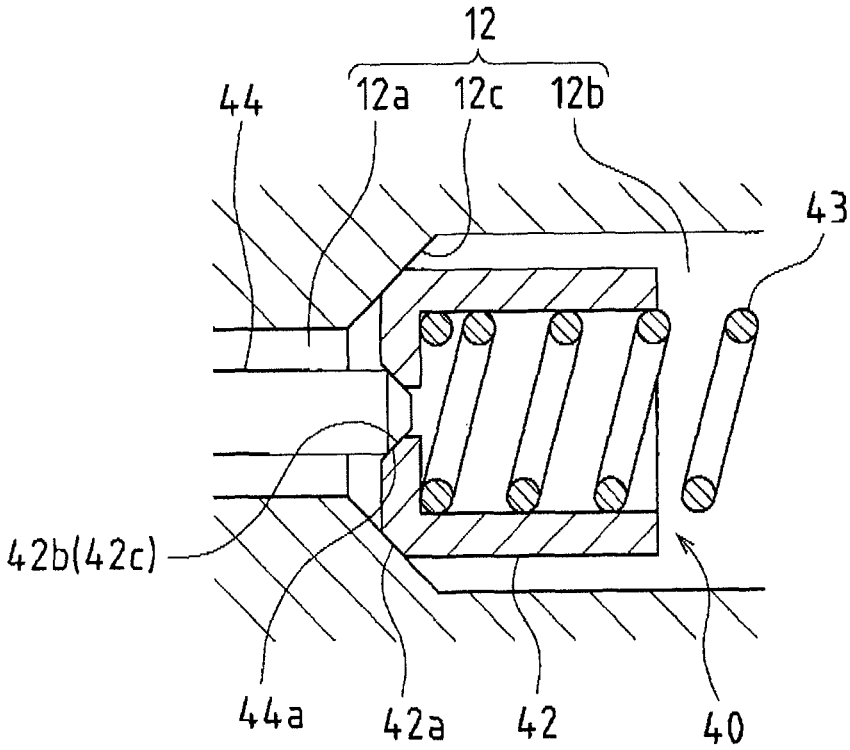
FIG. 4 is a cross-sectional diagram showing a configuration of a check valve and parts in the periphery thereof.

As shown in FIGS. 3 and 4, the check valve 40 includes a spring base element 41 that has been fitted into the fuel discharge passage 12, a valve element 42 as a discharge valve element that can come into and out of contact with the inner wall face of the fuel discharge passage 12, and a coil spring (biasing portion) 43 that biases the valve element 42 in the valve closing direction.

Specifically, as shown in FIG. 4, regarding the shape of the fuel discharge passage 12, the fuel discharge passage 12 includes a small diameter passage 12*a* whose diameter is relatively small and that is in communication with the compression chamber 22, a large diameter passage 12*b* whose diameter is relatively large and that is a space in which the spring base element 41, the valve element 42, and the coil spring 43 are arranged, and an increasing diameter passage 12*c* formed by a taper face that connects the inner wall faces of the small diameter passage 12*a* and the large diameter passage 12*b*.

The spring base element 41 is a cylindrical member whose outer diameter dimension substantially matches the inner diameter dimension of the large diameter passage 12*b*, and the spring base element 41 is fitted into and fixed to the large diameter passage 12*b*. Also, the front end face of the spring base element 41 (the end face on the increasing diameter passage 12*c* side) functions as a spring seating face against which one end of the coil spring 43 abuts.

The valve element 42 has a bottomed-cylinder shape, and one end of the coil spring 43 abuts against the bottom face inside the valve element 42. In other words, the coil spring 43 is interposed in a compressed state between the valve element 42 and the spring base element 41, and therefore the valve element 42 receives biasing force from the coil spring 43. Also, the outer circumferential edge of the tip portion of the valve element 42 (the tip portion on the small diameter passage 12*a* side) includes an outward incline face 42*a* that substantially conforms to the inner face shape (taper face shape) of the increasing diameter passage 12*c*. For this reason, the valve element 42 receives biasing force from the coil spring 43, and the outward incline face 42*a* abuts against the taper face of the increasing diameter passage 12*c*, and therefore the small diameter passage 12*a* and the large diameter passage 12*b* are blocked off. In other words, the taper face of the increasing diameter passage 12*c* constitutes a valve seat portion according to the present invention.

Note that on the downstream side of the check valve 40, the fuel discharge passage 12 is connected to the high pressure fuel pipe 105. When the fuel pressure in the space extending from inside the compression chamber 22 to the small diameter passage 12*a* has exceeded a predetermined value, the valve element 42 moves to a position separated from the taper face of the increasing diameter passage 12*c* against the biasing force of the coil spring 43. Accordingly, the check valve 40 enters the opened state, and high pressure fuel that has been pumped from the fuel discharge passage 12 is supplied to the delivery pipe 106 via the high pressure fuel pipe 105.

Also, a feature of the present embodiment is the configuration of the check valve 40 and the parts in the periphery thereof. The following is a specific description of such configurations.

A small-diameter opening 42*b* has been formed in the central portion of the valve element 42 of the check valve 40. The diameter of the opening 42*b* has been set to be smaller than the inner diameter dimension of the small diameter passage 12*a*. Also, the inner circumferential face of the opening 42*b* includes an inward incline face 42*c* that has been formed into a mortar shape in which the opening area gradually decreases toward the downstream side in the fuel flow direction (from the small diameter passage 12*a* toward the large diameter passage 12*b* side).

Also, the check valve 40 in the present embodiment includes a needle valve 44 that is a valve element (micro gap opening/closing element) for opening and closing the opening 42*b* formed in the central portion of the valve element 42. The tip portion of the needle valve 44 includes an incline face 44*a* that substantially conforms to the angle of inclination of the inward incline face 42*c* formed as the inner circumferential face of the opening 42*b*, and therefore the tip portion is shaped so as to taper off toward the tip side. On the other hand, as shown in FIG. 3, the base end portion of the needle valve 44 passes through the compression chamber 22 and is integrally linked to the valve element 35*a* of the electromagnetic spill valve 30. For this reason, the needle valve 44 operates in conjunction with the operation of the electromagnetic spill valve 30, and advances and retreats along the axis center direction as the valve element 35*a* advances and retreats.

Figure 6:
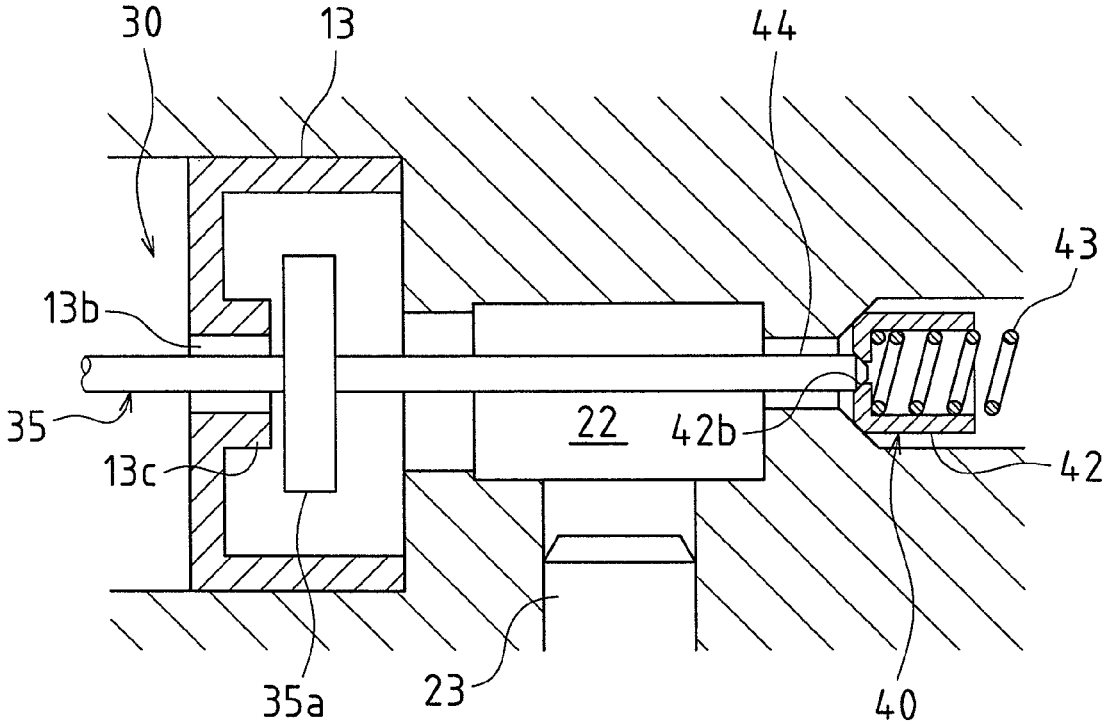
FIG. 6 is a cross-sectional diagram of parts in the periphery of the compression chamber in a state in which the electromagnetic spill valve is open.

Specifically, as shown in FIG. 6, the position of the tip of the needle valve 44 when the electromagnetic spill valve 30 is in the opened state is set such that the tip portion of the needle valve 44 is inserted into the opening 42*b* of the valve element 42 and closes the opening 42*b*, but does not apply biasing force in the valve opening direction to the valve element 42. In other words, this position (second advance/retreat position of the needle valve 44) is set such that the opening 42*b* is closed off, but the opening operation of the check valve 40 (the operation in which the outward incline face 42*a* of the valve element 42 separates from the taper face of the increasing diameter passage 12*c*) is not performed.

Figure 5:
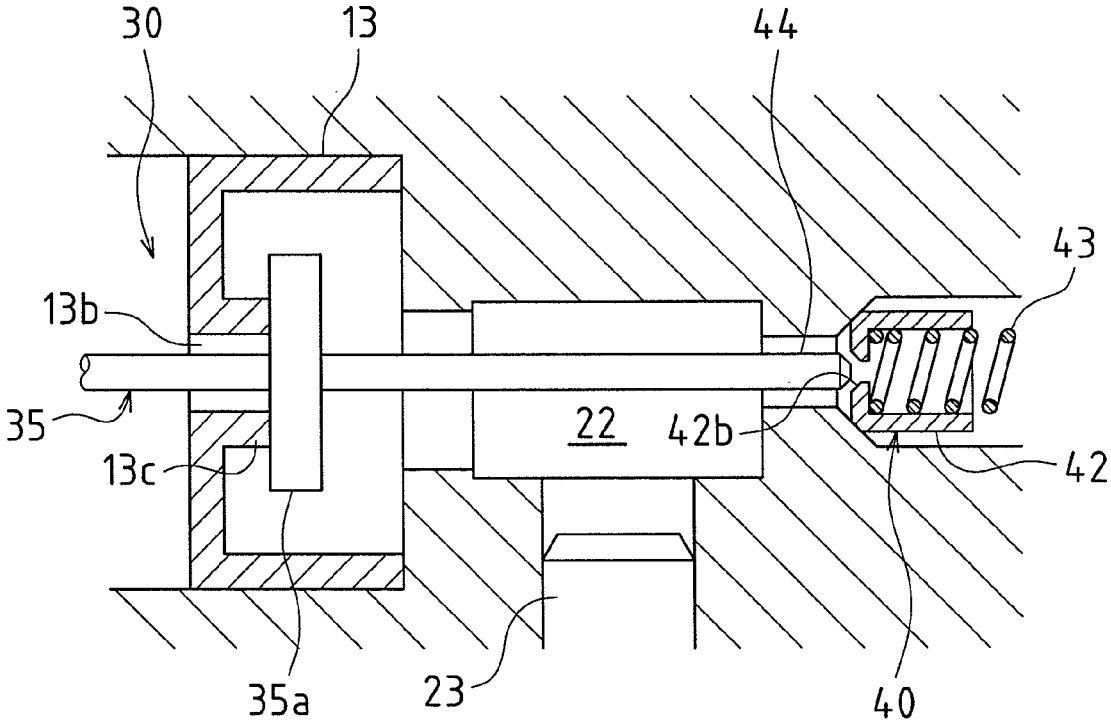
FIG. 5 is a cross-sectional diagram of parts in the periphery of a compression chamber in a state in which the electromagnetic spill valve is closed.

On the other hand, as shown in FIG. 5, the tip position of the needle valve 44 when the electromagnetic spill valve 30 is in the closed state is set to a position (first advance/retreat position of the needle valve 44) at which that the tip portion of the needle valve 44 retreats from the opening 42*b* of the valve element 42, thus forming a slight gap (micro gap) between the inner edge portion of the opening 42*b* and the tip portion of the needle valve 44. The above configuration constitutes the micro gap opening/closing portion according to the present invention. Also, the micro gap formed here is set as, for example, a slight gap of approximately 1 to 2 mm between the inner edge portion of the opening 42*b* and the tip portion of the needle valve 44, and the micro gap has been set such that in the case in which a difference in pressure exists between the upstream side and downstream side of the check valve 40, fuel gradually flows to the low pressure side.

—Check Valve 40 Operations—

Next is a description of operations of the check valve 40 configured as described above.

First, when the engine switches from the drive state to the stopped state, and the high pressure fuel pump 1 has stopped along with this, the pressure in the internal space of the delivery pipe 106 is in a high state since high pressure fuel had been pumped to the delivery pipe 106 via the high pressure fuel pipe 105 up to that time. In this situation, the conduction of electricity to the electromagnetic solenoid 31 of the electromagnetic spill valve 30 is started, and as shown in FIG. 5, the valve element 35*a* of the intake valve 35 is pulled toward the valve sheet 13*c* side and abuts against the valve sheet 13*c*, and thus the electromagnetic spill valve 30 enters the closed state. In conjunction with the movement of the valve element 35*a*, the tip portion of the needle valve 44 retreats from the opening 42*b* of the valve element 42, and a slight gap is formed between the inner edge portion of the opening 42*b* and the tip portion of the needle valve 44. For this reason, communication between the high pressure fuel pipe 105, which is a space on the downstream side of the check valve 40, and the compression chamber 22 is opened by the micro gap, and fuel gradually returns to the compression chamber 22 side via the micro gap, and thus the internal pressure in the delivery pipe 106 decreases. This consequently prevents the leakage of fuel from the injectors 4 into the cylinders.

Then, when the engine is driven, the high pressure fuel pump 1 has also started along with this, and the intake stroke in which the plunger 23 descends is performed, electrical conduction to the electromagnetic solenoid 31 is cancelled (the state of non-electrical conduction is entered), and as shown in FIG. 6, the valve element 35*a* of the intake valve 35 separates from the valve sheet 13*c* due to the biasing force of the coil spring 37, and thus the electromagnetic spill valve 30 enters the opened state. In conjunction with the movement of the valve element 35*a*, the tip portion of the needle valve 44 advances toward the opening 42*b* of the valve element 42, and the opening 42*b* of the valve element 42 is obstructed by the tip portion of the needle valve 44. For this reason, the high pressure fuel pipe 105, which is the space on the downstream side of the check valve 40, and the compression chamber 22 are blocked off, and in the intake stroke, fuel is prevented from back-flowing from the high pressure fuel pipe 105 toward the compression chamber 22, and thus only fuel that has been supplied from the feed pump 102 is introduced into the compression chamber 22. Note that in the intake stroke, the valve element 42 does not move in the valve opening direction since the pressure inside the compression chamber 22 is low (e.g., is a low pressure approximately the same as the discharge pressure of the feed pump 102). As a result, it is possible to maintain a high discharge efficiency of the high pressure fuel pump 1, and it is also possible to avoid the occurrence of cavitation erosion that arises due to the back-flow of fuel.

Note that when the compression stroke in which the plunger 23 ascends is performed, at a predetermined timing, electricity is conducted to the electromagnetic solenoid 31 and the electromagnetic spill valve 30 enters the closed state (see FIG. 5), and the check valve 40 is released at the time when the fuel pressure in the compression chamber 22 has reached a predetermined value. Specifically, when the fuel pressure in the space extending from inside the compression chamber 22 to the small diameter passage 12*a* has exceeded a predetermined value, the valve element 42 moves to a position separated from the taper face of the increasing diameter passage 12*c* against the biasing force of the coil spring 43, and thus the check valve 40 enters the opened state, and high pressure fuel that has been pumped from the fuel discharge passage 12 is supplied to the delivery pipe 106 via the high pressure fuel pipe 105. At this time, the valve element 42 retreats from the tip portion of the needle valve 44 as well, and thus the opening area of the gap formed between the inner edge portion of the opening 42*b* and the tip portion of the needle valve 44 increases, high pressure fuel can be discharged not only via the discharge passage formed between the valve element 42 and the taper face of the increasing diameter passage 12*c*, but also with use of the opening 42*b* formed in the valve element 42, and it is therefore possible to reduce pressure loss with respect to fuel discharge. Note that in the initial stage of the compression stroke, in the period until the fuel pressure in the compression chamber 22 reaches the predetermined value, that is to say, in the state in which the check valve 40 has not yet been released, the opening 42*b* is in a released state, but the gap formed by the opening 42*b* is minute, and therefore the amount of fuel that flows through is slight, and there is almost no adverse affect on the rise in pressure in the compression chamber 22.

As described above, according to the present embodiment, it is possible to realize the high pressure fuel pump 1 having a high discharge efficiency by preventing the back-flow of fuel in the intake stroke, while also preventing the leakage of fuel from the injectors 4 when the pump has been stopped.

Also, according to the configuration of the present embodiment, when either of the electromagnetic spill valve 30 and the check valve 40 is opened, the other is closed, and therefore the internal space in the delivery pipe 106 and the fuel tank 101 are not directly in communication. For this reason, there is no situation in which the internal pressure in the delivery pipe 106 has fallen to approximately the internal pressure in the fuel tank 101. As a result, the internal pressure in the delivery pipe 106 can be raised to a necessary pressure (e.g., 13 MPa) in a short time after the engine has started, and favorable engine starting properties can be ensured.

Embodiment 2

Next is a description of Embodiment 2.

The electromagnetic spill valve 30 of the high pressure fuel pump 1 in Embodiment 1 described above is a so-called "normally open" type of valve that opens due to the biasing force of the coil spring 37 when electrical conduction to the electromagnetic solenoid 31 is stopped.

Instead, the present embodiment describes the case in which the present invention has been applied to a high pressure fuel pump 1 that includes a so-called "normally closed" type of electromagnetic spill valve 30 that closes when electrical conduction to the electromagnetic solenoid 31 is stopped. In other words, the high pressure fuel pump 1 according to the present embodiment is configured such that biasing force in the valve closing direction is applied to the intake valve 35 of the electromagnetic spill valve 30 by a coil spring or the like, and furthermore is configured such that when electricity is conducted to the electromagnetic solenoid 31, the intake valve 35 moves in the valve opening direction against the biasing force. The other configurations are similar to those in Embodiment 1 described above, and therefore descriptions thereof have been omitted.

The following describes operations of the check valve 40 in the high pressure fuel pump 1 having such a configuration.

When the engine switches from the drive state to the stopped state, and the high pressure fuel pump 1 has stopped along with this, electrical conduction to the electromagnetic solenoid 31 of the electromagnetic spill valve 30 is canceled (the state of non-electrical conduction is entered), and as shown in FIG. 5, the valve element 35*a* of the intake valve 35 is pulled to the valve sheet 13*c* side by the biasing force and abuts against the valve sheet 13*c*, and thus the electromagnetic spill valve 30 enters the closed state. In conjunction with the movement of the valve element 35*a*, the tip portion of the needle valve 44 retreats from the opening 42*b* of the valve element 42, and a slight gap is formed between the inner edge portion of the opening 42*b* and the tip portion of the needle valve 44. Accordingly, similarly to the case in Embodiment 1 described above, fuel gradually returns to the compression chamber 22 side via the micro gap, and thus the internal pressure in the delivery pipe 106 decreases. This consequently prevents the leakage of fuel from the injectors 4 into the cylinders.

On the other hand, when the engine is driven, the high pressure fuel pump 1 is started along with this, and the intake stroke in which the plunger 23 descends is performed, electricity is conducted to the electromagnetic solenoid 31, and as shown in FIG. 6, the valve element 35*a* of the intake valve 35 separates from the valve sheet 13*c* against the biasing force, and thus the electromagnetic spill valve 30 enters the opened state. In conjunction with the movement of the valve element 35*a*, the tip portion of the needle valve 44 advances toward the opening 42*b* of the valve element 42, and the opening 42*b* of the valve element 42 is obstructed by the tip portion of the needle valve 44. Accordingly, similarly to the case in Embodiment 1 described above, fuel is prevented from back-flowing from the high pressure fuel pipe 105 toward the compression chamber 22 in the intake stroke, and thus only fuel that has been supplied from the feed pump 102 is introduced into the compression chamber 22. As a result, it is possible to maintain a high discharge efficiency of the high pressure fuel pump 1, and the occurrence of cavitation erosion that arises due to the back-flowing of fuel is avoided.

Note that when the compression stroke in which the plunger 23 ascends is performed, at a predetermined timing, electrical conduction to the electromagnetic solenoid 31 is canceled and the electromagnetic spill valve 30 enters the closed state (see FIG. 5), the check valve 40 is released at the time when the fuel pressure in the compression chamber 22 has reached a predetermined value, and high pressure fuel that has been pumped from the fuel discharge passage 12 is supplied to the delivery pipe 106 via the high pressure fuel pipe 105. In this case as well, the valve element 42 retreats from the tip portion of the needle valve 44, and thus the opening area of the gap formed between the inner edge portion of the opening 42*b* and the tip portion of the needle valve 44 increases, high pressure fuel can be discharged not only via the discharge passage formed between the valve element 42 and the taper face of the increasing diameter passage 12*c*, but also with use of the opening 42*b* formed in the valve element 42, and it is therefore possible to reduce pressure loss with respect to fuel discharge.

In this way, even in the case of applying the present invention to the high pressure fuel pump 1 that includes the normally closed type of electromagnetic spill valve 30, it is possible to achieve the same effects as the case in Embodiment 1 described above.

Embodiment 3

Next is a description of Embodiment 3.

In Embodiments 1 and 2 described above, when the high pressure fuel pump 1 is stopped, the needle valve 44 retreats from the opening 42*b* of the valve element 42, and a micro gap is constantly formed between the inner edge portion of the opening 42*b* and the tip portion of the needle valve 44.

Instead, in the present embodiment, at the time when the high pressure fuel pump 1 has switched from the drive state to the stopped state, the needle valve 44 is caused to retreat from the opening 42*b* of the valve element 42, a micro gap is formed between the inner edge portion of the opening 42*b* and the tip portion of the needle valve 44, and at a predetermined timing, the opening 42*b* is obstructed by the needle valve 44, thus preventing the micro gap from being formed.

In other words, when the engine switches from the drive state to the stopped state, and the high pressure fuel pump 1 has stopped along with this, as shown in FIG. 5, the tip portion of the needle valve 44 is caused to retreat from the opening 42*b* of the valve element 42, and a slight gap is formed between the inner edge portion of the opening 42*b* and the tip portion of the needle valve 44. Accordingly, fuel gradually returns to the compression chamber 22 side via the micro gap, and thus the internal pressure in the delivery pipe 106 decreases.

Then, when the value of the fuel pressure in the delivery pipe 106 that is detected by the fuel pressure sensor 161 attached to the delivery pipe 106 has fallen to a value at which the leakage of fuel from the injectors 4 into the cylinders can be prevented (i.e., when the value has fallen to, for example, 5 Mpa), the needle valve 44 is advanced, thus blocking the opening 42*b* and preventing the formation of the micro gap. Accordingly, the high pressure fuel pipe 105 and the compression chamber 22 are blocked off, and the return of fuel to the compression chamber 22 side is stopped. In other words, the pressure in the delivery pipe 106 is continuously maintained at a relatively high value in a range in which the leakage of fuel from the injectors 4 can be prevented. For this reason, it is possible to avoid the situation in which the pressure in the delivery pipe 106 falls more than necessary, and when the engine is restarted, the pressure in the delivery pipe 106 can be raised to a necessary pressure (e.g., 13 MPa) in a short amount of time, thus ensuring that the engine has favorable starting properties.

In particular, the configuration according to the present embodiment is effective in the case of being applied to the high pressure fuel pump 1 that includes the normally open type of electromagnetic spill valve 30. The reason for this is that, as described in Embodiment 1, in the case of the normally open type of electromagnetic spill valve 30, it is necessary to continuously conduct electricity to the electromagnetic solenoid 31 in order to cause the tip portion of the needle valve 44 to retreat from the opening 42*b* of the valve element 42 to form the micro gap. Also, in order for the micro gap to be continuously formed when the high pressure fuel pump 1 is stopped, it is necessary to continuously conduct electricity to the electromagnetic solenoid 31 for a long period of time, thus leading to an increase in power consumption.

In the present embodiment, when the value of the fuel pressure in the delivery pipe 106 that is detected by the fuel pressure sensor 161 has fallen to a value at which the leakage of fuel from the injectors 4 into the cylinders can be prevented, the needle valve 44 is caused to advance, thus blocking the opening 42*b* and preventing the formation of the micro gap. In other words, electrical conduction to the electromagnetic solenoid 31 is canceled. For this reason, the need to operate the needle valve 44 even in the situation in which the engine has not been driven for a long period of time is eliminated, thus enabling a reduction in power consumption.

Other Embodiments

The above embodiments describe cases in which the present invention has been applied to an in-cylinder direct injection type of four-cylinder gasoline engine mounted in an automobile. The present invention is not limited to this, and can be applied to, for example, a gasoline engine having another arbitrary number of cylinders, such as an in-cylinder direct injection type of six-cylinder gasoline engine. Also, the present invention is not limited to application to a gasoline engine, and can be applied to another internal combustion engine such as a diesel engine. Furthermore, the engine to which the present invention is applicable is not limited to an automobile engine.

Also, although the high pressure fuel pump 1 in the embodiments is configured such that the plunger 23 is driven by the rotation of the drive cam 111 attached to the exhaust cam shaft 110, a configuration is possible in which the plunger 23 is driven by the rotation of a drive cam that is attached to an intake cam shaft.

Furthermore, the present invention is not limited to the inclusion of the drive cam 111 that has the two cam noses 112, and is applicable in the case of the inclusion of a drive cam that has another number of cam noses as well.

Also, although the high pressure fuel pump 1 in the embodiments is a plunger pump, the present invention is applicable with respect to other positive displacement pumps (e.g., a piston pump or vane pump) as well.

Also, in the embodiments, the present invention has been applied to the high pressure fuel pump 1 that includes the electromagnetic spill valve 30, and furthermore the intake valve 35 of the electromagnetic spill valve 30 and the check valve 40 are arranged on the same axial line. The present invention is not limited to this, and a configuration is possible in which an opening/closing valve other than the electromagnetic spill valve 30 is provided on the intake side, and the opening/closing valve and the needle valve 44 are caused to operate in conjunction. Also, the configuration for transmitting the opening/closing drive power of the electromagnetic spill valve 30 to the needle valve 44 is not limited to directly linking the valve element 35*a* of the electromagnetic spill valve 30 to the needle valve 44 as in the embodiments, and a configuration is possible in which the opening/closing drive power is transmitted to the needle valve 44 via a link mechanism or the like. In this case, the need to arrange the intake valve 35 of the electromagnetic spill valve 30 and the check valve 40 on the same axial line is eliminated, thus improving the degree of freedom in the layout of the valves.

Also, although the needle valve 44 is caused to operate in conjunction with the electromagnetic spill valve 30 in the embodiments described above, the scope of the technical idea of the present invention also encompasses a configuration in which the needle valve 44 is provided with a dedicated drive source (an electromagnetic solenoid or an electric motor), and the needle valve 44 is caused to operate as in the embodiments described above according to the driving of the drive source.

The present invention can be implemented in various other forms without departing from the spirit or principal features of the present invention. The embodiments described above are therefore nothing more than illustrative in every respect, and should not be interpreted in a limiting way. The scope of the present invention is defined by the scope of the claims, and should not be restricted to the foregoing description in any way. Furthermore, all variations and modifications within a scope equivalent to the scope of the claims are encompassed in the scope of the present invention.

This application claims priority on Japanese Patent Application No. 2007-206185 filed in Japan on Aug. 8, 2007. The entire content of the above application is hereby incorporated in the present application by reference. Also, all of the documents cited in the present description are hereby specifically incorporated in the present application by reference.

REFERENCE SIGNS LIST

1 high pressure fuel pump
4 injector (fuel injection valve)
12 fuel discharge passage
12*c* large diameter passage (valve seat portion)
21 cylinder
22 compression chamber
23 plunger
30 electromagnetic spill valve
31 electromagnetic solenoid (drive source)
42 valve element (discharge valve element)
42*b* opening
43 coil spring (biasing portion)
44 needle valve (micro gap opening/closing element)

The invention claimed is:

1. A fuel pump provided with a compression chamber for compressing fuel, and a discharge valve element that is arranged on a discharge side of the compression chamber and to which biasing force in a valve closing direction of the discharge valve element is applied, and being configured such that fuel is taken into the compression chamber in an intake stroke, and in a case in which pressure in the compression chamber has reached or exceeded a predetermined pressure in a compression stroke, the discharge valve element moves in a valve opening direction of the discharge valve element against the biasing force, and fuel is discharged from the compression chamber toward a fuel injection valve, the fuel pump comprising:

a micro gap opening/closing portion that, in a case of a change from a pump drive state to a pump stopped state, causes the compression chamber and a space on a downstream side of the discharge valve element to be in communication with use of a micro gap, and in at least the intake stroke during pump driving, obstructs the micro gap, wherein an opening that enables communication between the compression chamber and the space on the downstream side of the discharge valve element is formed in the discharge valve element, the micro gap opening/closing portion is provided with a micro gap opening/closing element that can advance and retreat between a first advance/retreat position reached by retreating from the opening of the discharge valve element to release the opening and cause the compression chamber and the space on the downstream side of the discharge valve element to be in communication, and a second advance/retreat position reached by advancing toward the opening of the discharge valve element to obstruct the opening and block off the compression chamber and the space on the downstream side of the discharge valve element, and the micro gap opening/closing element is configured so as to open and close the micro gap formed between an inner edge portion of the opening and the micro gap opening/closing element by, with use of an electromagnetic solenoid as a drive source, moving between the first advance/retreat position and the second advance/retreat position according to conduction/non-conduction of electricity to the electromagnetic solenoid.

2. The fuel pump according to claim 1, wherein the compression chamber is defined by a cylinder and a plunger that reciprocates in the cylinder, the fuel pump is configured such that a spill valve that can perform an opening and closing operation according to operation of the electromagnetic solenoid is provided on an intake side of the compression chamber, and a pumping amount is adjusted by controlling the opening and closing operation of the spill valve during the compression stroke in which the plunger is moving in a direction for reducing a volume of the compression chamber, and the fuel pump is configured such that the micro gap opening/closing element of the micro gap opening/closing portion is linked to the spill valve, reaches the second advance/retreat position by operating in conjunction with an opening operation of the spill valve, and reaches the first advance/retreat position by operating in conjunction with a closing operation of the spill valve.

3. The fuel pump according to claim 1, wherein the discharge valve element can close a discharge passage on a discharge side of the compression chamber by being caused, due to receiving biasing force of a biasing portion, to abut against a valve seat portion formed in the discharge passage, and in a case in which pressure in the compression chamber has reached or exceeded the predetermined pressure in the compression stroke, the discharge valve element releases the discharge passage by retreating from the valve seat portion against the biasing force of the biasing portion, and fuel is discharged from the compression chamber, and the fuel pump is configured such that after the micro gap opening/closing element is at the second advance/retreat position and the opening of the discharge valve element is obstructed in the intake stroke, the compression stroke is performed, the micro gap opening/closing element reaches the first advance/retreat position, the pressure in the compression chamber reaches or exceeds the predetermined pressure, and the discharge valve element retreats from the valve seat portion and retreats from the micro gap opening/closing element, and accordingly fuel is discharged from the opening of the discharge valve element as well.

4. The fuel pump according to claim 2, wherein the discharge valve element can close a discharge passage on a discharge side of the compression chamber by being caused, due to receiving biasing force of a biasing portion, to abut against a valve seat portion formed in the discharge passage, and in a case in which pressure in the compression chamber has reached or exceeded the predetermined pressure in the compression stroke, the discharge valve element releases the discharge passage by retreating from the valve seat portion against the biasing force of the biasing portion, and fuel is discharged from the compression chamber, and the fuel pump is configured such that after the micro gap opening/closing element is at the second advance/retreat position and the opening of the discharge valve element is obstructed in the intake stroke, the compression stroke is performed, the micro gap opening/closing element reaches the first advance/retreat position, the pressure in the compression chamber reaches or exceeds the predetermined pressure, and the discharge valve element retreats from the valve seat portion and retreats from the micro gap opening/closing element, and accordingly fuel is discharged from the opening of the discharge valve element as well.

* * * * *